US008459955B2

(12) United States Patent
McMillan et al.

(10) Patent No.: US 8,459,955 B2
(45) Date of Patent: Jun. 11, 2013

(54) AEROFOIL

(75) Inventors: Alison J McMillan, Uttoxeter (GB); Ian C D Care, Derby (GB)

(73) Assignee: Rolls-Royce PLC, London (GB)

( * ) Notice: Subject to any disclaimer, the term of this patent is extended or adjusted under 35 U.S.C. 154(b) by 970 days.

(21) Appl. No.: 12/458,768

(22) Filed: Jul. 22, 2009

(65) Prior Publication Data

US 2010/0054945 A1 Mar. 4, 2010

(30) Foreign Application Priority Data

Aug. 28, 2008 (GB) ..... 0815567.3

(51) Int. Cl.
*F01D 5/14* (2006.01)

(52) U.S. Cl.
USPC ..... 416/224; 416/231 R; 416/233; 29/889.7

(58) Field of Classification Search
USPC ..... 415/119; 416/62, 207, 213 R, 214 R, 416/224, 231 R, 231 B, 233; 29/889.7, 889.71, 29/889.72
See application file for complete search history.

(56) References Cited

U.S. PATENT DOCUMENTS

| | | | | | |
|---|---|---|---|---|---|
| 1,490,256 | A | * | 4/1924 | Caldwell et al. | 416/224 |
| 1,842,178 | A | * | 1/1932 | Kempton | 416/224 |
| 2,574,980 | A | * | 11/1951 | Meyers | 416/226 |
| 3,200,477 | A | * | 8/1965 | Shultz | 29/889.72 |
| 3,552,881 | A | * | 1/1971 | Rogers et al. | 416/145 |
| 4,095,322 | A | * | 6/1978 | Scarpati et al. | 29/889.6 |
| 4,565,490 | A | * | 1/1986 | Rice | 415/114 |
| 4,667,906 | A | * | 5/1987 | Suarez et al. | 244/124 |
| 4,738,594 | A | * | 4/1988 | Sato et al. | 416/224 |
| 4,895,491 | A | * | 1/1990 | Cross et al. | 416/224 |
| 4,944,655 | A | * | 7/1990 | Merz | 416/61 |
| 5,144,825 | A | * | 9/1992 | Burg et al. | 72/60 |
| 5,165,859 | A | * | 11/1992 | Monroe | 416/224 |
| 5,210,946 | A | * | 5/1993 | Monroe | 29/889.71 |
| 5,782,607 | A | * | 7/1998 | Smith et al. | 416/224 |
| 5,827,045 | A | * | 10/1998 | Beeck | 416/96 A |
| 6,183,201 | B1 | * | 2/2001 | Maby | 416/170 R |
| 8,043,065 | B2 | * | 10/2011 | Kyriakides | 416/224 |
| 2007/0092379 | A1 | * | 4/2007 | Coupe et al. | 416/241 R |
| 2008/0075601 | A1 | | 3/2008 | Giusti et al. | |

FOREIGN PATENT DOCUMENTS

| | | |
|---|---|---|
| GB | 1 320 539 A | 12/1970 |
| GB | 1 556 181 | 11/1979 |
| GB | 2 218 473 A | 11/1989 |

OTHER PUBLICATIONS

Nov. 19, 2012 Search Report issued in European Patent Application No. 09251846.

* cited by examiner

*Primary Examiner* — Edward Look
*Assistant Examiner* — Aaron R Eastman
(74) *Attorney, Agent, or Firm* — Oliff & Berridge, PLC

(57) ABSTRACT

Composite aerofoils for gas turbine engines are commonly provided with a metal protection strip along the leading edge, to prevent erosion of the leading edge in use and to protect against impacts from foreign bodies. A problem with such strips is that they can cause serious damage to other parts of the engine if they become detached from the aerofoil. The invention provides an aerofoil having such a protection strip, characterized in that the protection strip includes one or more weakening features to reduce the ability of the protection member to withstand a compressive force applied along its length. The weakening features encourage the protection member to break up under impact, or if it becomes detached from the aerofoil, so that damage to other parts of the engine is minimized.

11 Claims, 5 Drawing Sheets

PRIOR ART

AEROFOIL

The present invention relates to aerofoils, particularly but not exclusively aerofoils for gas turbine engines.

Gas turbine engines include aerofoils in the form of components such as blades and vanes. It is known for such blades and vanes to be formed of an organic matrix composite material. Such materials are relatively brittle, and subject to damage from erosion and impact. It is known to provide a protection strip along the leading edge of such aerofoils which is formed of a metal, and is fixed in position on the aerofoil by bonding with an adhesive. However in use such protection strips can become detached leading to collision of the protection strip with a casing of the engine, causing damage.

A possible cause of the debonding of the protection strips from the aerofoils is that, in use, the protection strips can adopt vibration modes at particular frequencies which can lead to debonding.

According to a first aspect of the present invention, there is provided an aerofoil for a gas turbine engine, the aerofoil including a body and a protection member, the protection member defining a weakening hole which is arranged, in use, to reduce the ability of the protection member to withstand a compressive force applied along its length.

The protection member may have a length, and the weakening hole may extend transversely across the length of the protection member.

The weakening hole may be in the form of an aperture which extends through the protection member.

The weakening hole may be in the form of a recess which extends only partially through the protection member.

The protection member may include a plurality of weakening holes.

Possibly, the protection member includes a protection member body, a pair of spaced wings extending outwardly from the body, the spaced wings defining an aerofoil body receiving recess therebetween, the protection member including a stiffening member which extends between the wings.

According to a second aspect of the present invention, there is provided an aerofoil for a gas turbine engine, the aerofoil including a body and a protection member, the protection member including a protection member body, a pair of spaced wings extending outwardly from the protection member body, the wings defining an aerofoil body receiving recess therebetween, the protection member including a stiffening member which extends between the wings.

Possibly the aerofoil includes any of the features described in the preceding statements.

Possibly the stiffening member is in the form of a web. The web may define one or more apertures, which may extend through the web. Possibly the or each web aperture corresponds in longitudinal position with the or one weakening hole.

Possibly the stiffening member includes a first part and a second part which in use engage each other, the first part extending through one wing into the aerofoil body, the second part extending through the other wing into the aerofoil body. Possibly the first part and the second part threadably engage. Possibly the first part and the second part each taper inwardly.

Possibly the protection member includes a plurality of stiffening members.

Possibly, the aerofoil body includes an interlocking formation to provide interlock between the aerofoil body and the protection member. The interlocking formation may be in the form of a protruding part, which protrudes into the aerofoil body receiving recess beyond the stiffening member. Possibly, the interlocking formation is in the form of an aerofoil body projection which extends outwardly from the aerofoil body, and projects into the or one weakening hole to provide interlock between the aerofoil body and the protection member.

Possibly, the aerofoil includes a filler, which is located in a cavity defined between the aerofoil body and the protection member. Possibly the filler includes one or more inclusions, which may be hollow, and which may be crushable. Possibly the filler is formed of a visco elastic material and may be formed of a foamed material.

The protection member may be formed of a metallic material. The aerofoil body may be formed of a composite material, and may be formed of an organic matrix composite material. The aerofoil body may be formed by moulding.

According to a third aspect of the present invention, there is provided a gas turbine engine, the engine including an aerofoil including any of the features described above.

According to a further aspect of the present invention, there is provided a method of forming an aerofoil, the aerofoil including an aerofoil body and a protection member, the protection member being formed of a metallic material, the aerofoil body being formed of a composite material, the method including the steps of locating the protection member in a mould, and then locating the composite material in the mould to form the aerofoil body against the protection member.

Possibly the aerofoil includes any of the features described in any of the preceding statements.

Embodiments of the present invention will now be described, by way of example only, and with reference to the accompanying drawings, in which:—

Figure 1:
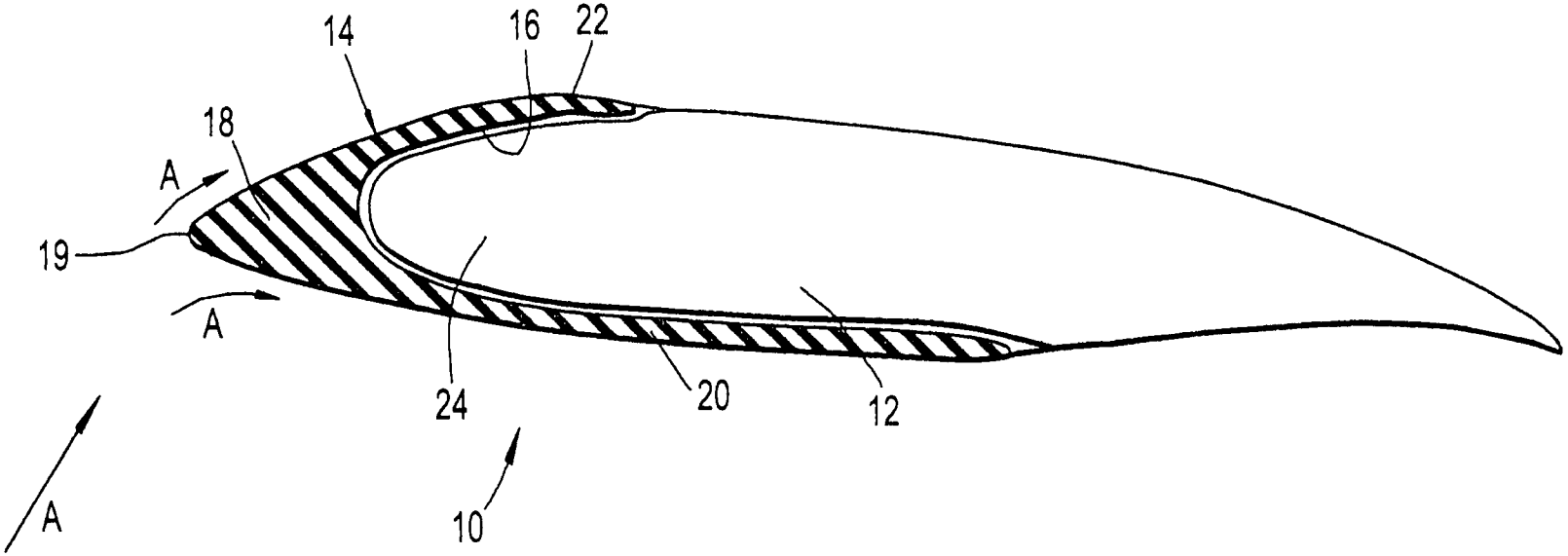
Fig.1 PRIOR ART
FIG. 1 is a side cross sectional view of a known aerofoil.
Figure 2:
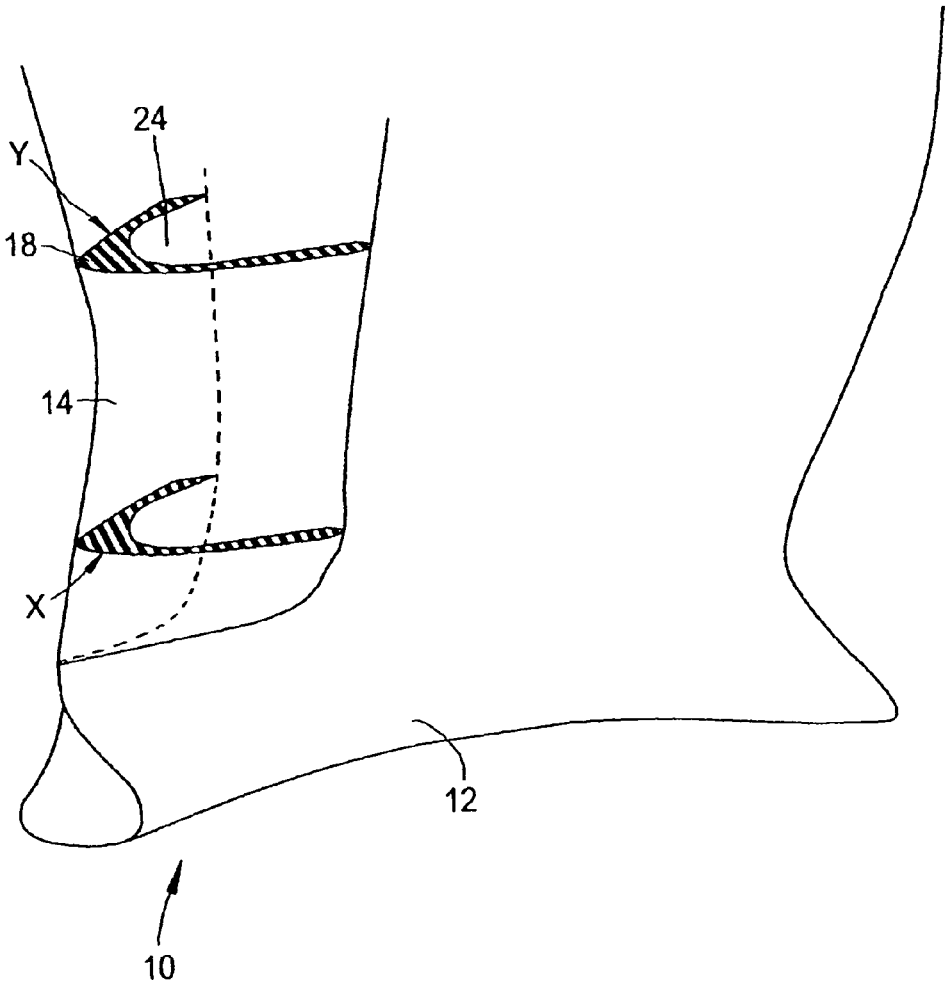
FIG. 2 is a schematic perspective view of part of the known aerofoil of FIG. 1, with X and Y designating perspective cut section views of a protection member at different locations.

Referring to FIGS. 1 and 2, a known aerofoil 10 includes an aerofoil body 12 and a protection member 14. The aerofoil body 12 has a length and the protection member 14 has a length, and the length of the protection member 14 extends along at least part of the length of the aerofoil body 12. The protection member 14 forms a leading edge of the aerofoil 10.

The protection member 14 includes a protection member body 18 which extends to a tip 19. The protection member 14 includes a first wing 20 and a second wing 22 which are spaced apart from each other and extend outwardly from the body 18 away from the tip 19. The first wing 20 is relatively longer than the second wing 22. The protection member 14 defines a recess 24 between the wings 20, 22 in which a part of the aerofoil body 12 is receivable. An adhesive layer 16 is located between the protection member 14 and the aerofoil body 12 to bond the protection member 14 to the aerofoil body 12.

Figure 4:
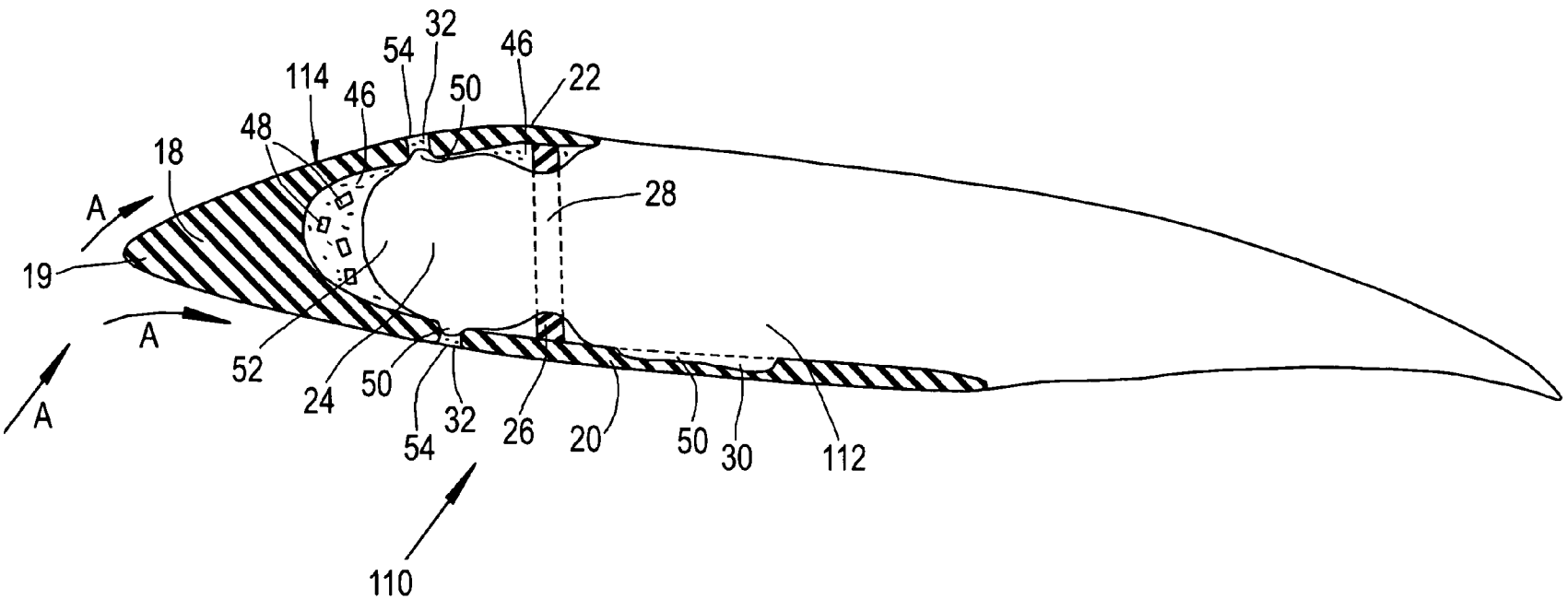
FIG. 4 is a side cross sectional view of an aerofoil according to the invention.

In use, air flows around the aerofoil 10 as indicated by arrows A in FIG. 4. The tip 19 forms a leading edge of the aerofoil 10, and is thus subject to impact by particles carried by the airflow which can cause erosion and by large objects such as birds. Impact upon the tip 19 or either of the wings 20, 22 can have the effect of deforming the protection member 14. Since the protection member 14 is formed of a metallic material, it is able to accommodate a degree of deformation, having a resilient property, in contrast to the composite material of the aerofoil body 12 which has little resilient property. Impact can therefore lead to debonding by relative movement between the protection member 14 and the aerofoil body 12. In particular, in the arrangement shown in FIGS. 1 and 2, the wings 20, 22 can move towards and away from each other.

Another mechanism which can cause or contribute to debonding is by vibration induced by airflow. Where such vibration is in the frequency range of 20 seconds or greater, excitation can occur which is located within the protection member 14. Such vibration can be excited by upstream or downstream gas distortions from up or down stream blading. The excitation produces high strains in the adhesive layer 16 which can lead to local delamination of the protection member 14 from the aerofoil body 12. Over a period of time, the local delamination can develop, eventually leading to debonding.

In the event that debonding occurs, the protection member 14 can be flung outwardly by centrifugal force to impact a casing of the engine, causing damage.

Figure 3:
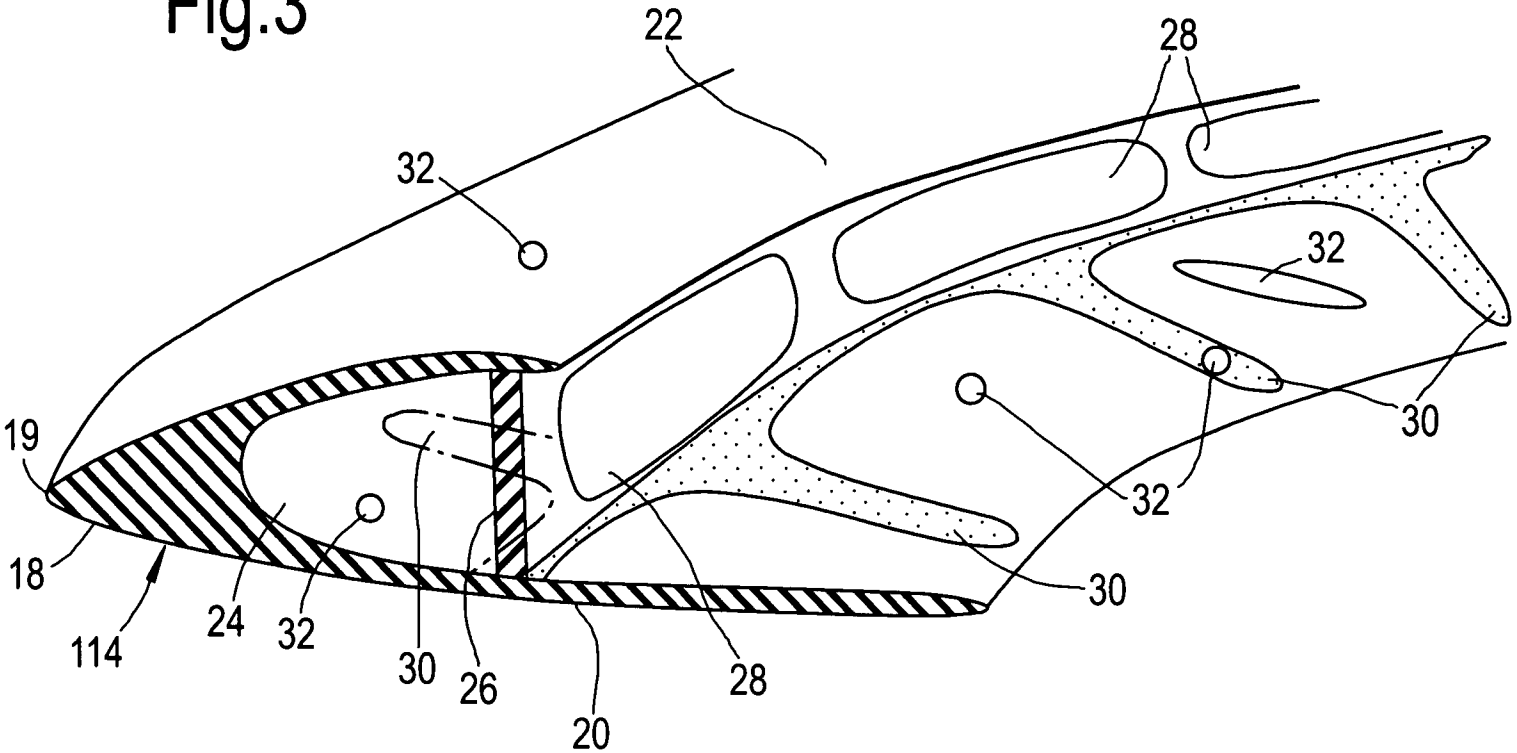
FIG. 3 is a perspective view of a protection member according to the invention with an end cut section.

FIG. 3 shows a protection member 114 according to the present invention. The protection member 114 has a length and includes a body 18 extending to a tip 19 and includes a pair of wings 20, 22 extending outwardly from the body 18 away from the tip 19. The wings 20, 22 define an aerofoil body receiving recess 24 therebetween.

The protection member 114 includes a plurality of weakening holes, which include a plurality of weakening apertures 32 and a plurality of weakening recesses 30. The weakening apertures 32 extend through the wings 20, 22 transversely to the length of the protection member 114. The weakening recesses 30 extend only partially through the wings 20, 22. The weakening recesses 30 are elongate, and extend in a direction transverse to the length of the protection member 114.

The protection member 114 includes a stiffening member in the form of a web 26 which extends between the first wing 20 and the second wing 22 along the length of the protection member 114. The web 26 defines a plurality of web apertures 28 therethrough. The locations of the elongate transversely extending weakening recesses 30 correspond longitudinally with the locations of the web apertures 28.

FIG. 4 shows an aerofoil 110. The aerofoil 110 includes an aerofoil body 112 and the protection member 114 shown in FIG. 3.

One example of a method of manufacture of the aerofoil 110 is as follows. The protection member 114 is formed of a metallic material by any suitable process such as casting or machining or fabrication or a combination thereof. The aerofoil body 112 is formed of a composite material, which could be, for example, an organic matrix composite material. The aerofoil 110 could be formed by moulding. The protection member 114 could be placed in a mould. The composite material is located into the mould against the protection member 114, so that a part 52 of the aerofoil body 112 protrudes through the web apertures 28 into the aerofoil body receiving recess 24 beyond the web 26. The composite material resin is injected to form the composite aerofoil body 112 and fills the remaining cavities. The weakening apertures 32 aid the resin infusion by providing outflow points. Thus the aerofoil body 112 could include projections 50 which project into the weakening apertures 32 and into the weakening recesses 30. The protruding part 52 and the projections 50 each form an interlocking formation which provides an interlock between the aerofoil body 112 and the protection member 114, to resist debonding of the protection member 114 from the aerofoil body 112.

A filler adhesive 46 is introduced into a gap defined between the aerofoil body 112 and the protection member 114. The filler adhesive 46 could include crushable hollow inclusions 48. The filler adhesive 46 could be an elastomeric or viscoelastic material, and may perform a damping function in use. Where the projections 50 only partially fill the weakening apertures 32, the weakening apertures 32 could be filled with a filling material 54, so that a smooth surface is presented to air flow over the aerofoil 110.

In use in an airflow, relative movement of the wings 20, 22 is resisted by the web 26, which ties the wings 20, 22 together. The web 26 also increases the second moment of area of the protection member 114, so that the protection member 114 is better able to resist bending forces applied as point loads along the length of the protection member 114 in the form of impacts. The visco elastic filler adhesive 46 with the crushable hollow inclusions 48 also serves to absorb movement of the protection member 114 relative to the aerofoil body 112, providing a shock absorbing barrier between the aerofoil body 112 and protection member 114.

Debonding of the protection member 114 from the aerofoil body 112 is liable to cause a change in the appearance of the filling 54 of the weakening apertures 32, thus providing a visual indication of debonding.

In the event that the protection member 114 debonds from the aerofoil body 112, the weakening recesses 30 and the weakening apertures 32 reduce the ability of the protection member 114 to withstand compressive forces applied along its length, thus reducing the possibility of damage being caused by the debonded protection member 114. Thus, if the protection member 114 debonds from the aerofoil body 112 in use, and impacts against a containment casing, the weakening recesses 30 and the weakening apertures 32 act as stress raisers, reducing the cross section thickness, so that the protection member 114 is likely to buckle more easily than would otherwise be the case, for example with the known protection member 14 of the aerofoil 10 shown in FIGS. 1 and 2. The longitudinal alignment of the weakening recesses 30 and the web apertures 28 also serves to reduce the ability of the protection member 114 to withstand compressive forces applied along its length.

Figure 5:
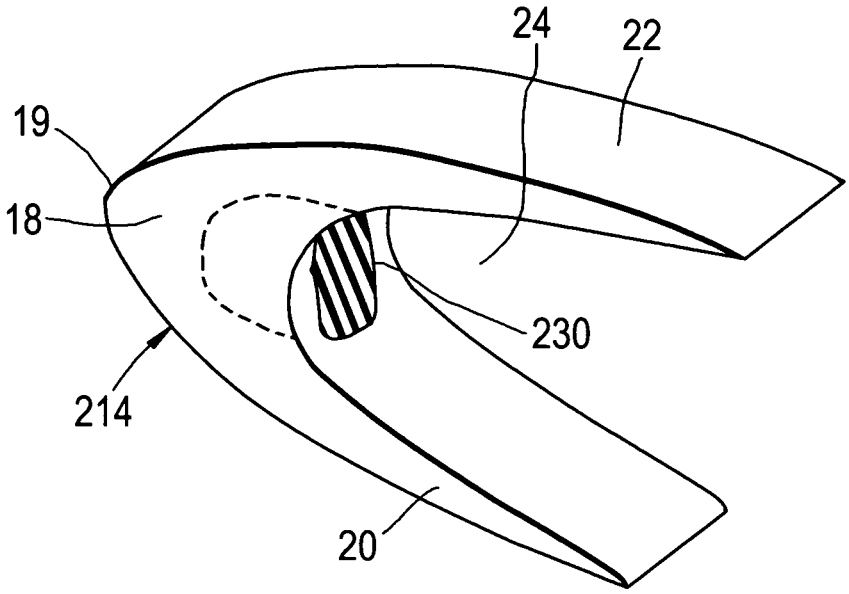
FIG. 5 is a perspective view of a section of another protection member.

FIG. 5 shows a section of another protection member 214, many features of which are similar to those previously described. Where features are the same or similar, the same reference numerals have been used, and these features will not be described again in detail for the sake of brevity.

The protection member 214 includes a body 18 which defines a weakening hole in the form of a recess 230 which extends from the aerofoil body receiving recess 24 into the body 18. As in the previous example, the weakening recess 230 could receive a projection of an aerofoil body in an assembled condition to provide interlock between the protection member 214 and the aerofoil body. In the event that the protection member 214 debonds from the aerofoil body, the weakening recess 230 weakens the ability of the protection member 214 to withstand a compressive force applied along its length by acting as a stress raiser, so that the possibility of damage caused by the debonded protection member 214 is reduced.

Figure 6:
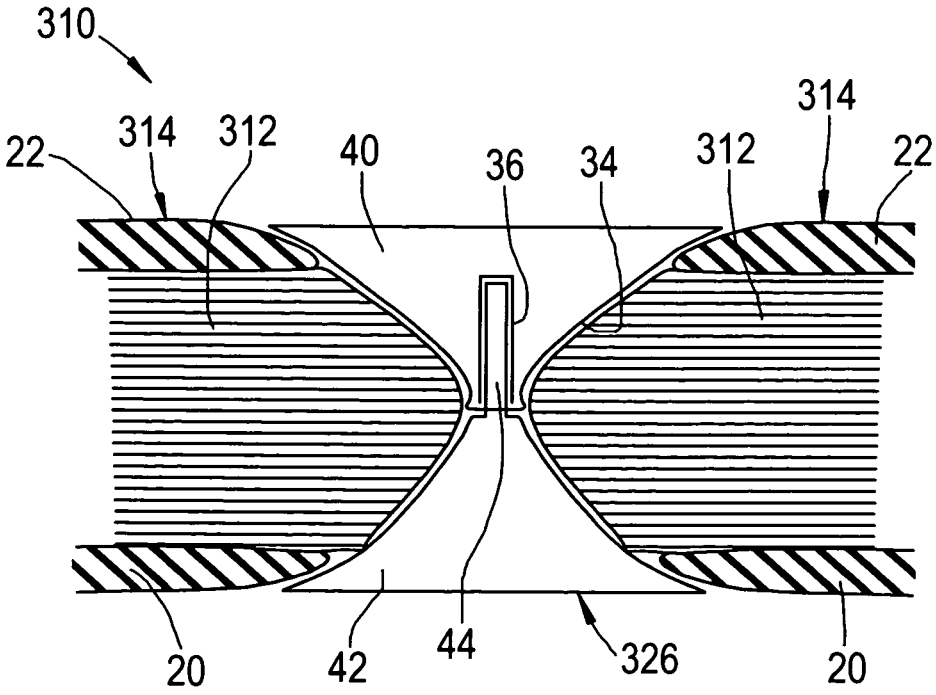
FIG. 6 is a side sectional view of part of another aerofoil according to the invention.

FIG. 6 shows a section of another aerofoil 310, many features of which are similar to those which have previously been described. Where features are the same or similar, the same or similar reference numerals have been used, and these features will not be described again in detail for the sake of brevity.

The aerofoil 310 includes a stiffening member 326 which includes a first part 40 and a second part 42. The aerofoil 310 defines a passage 34 which extends therethrough, extending through the first wing 20, the aerofoil body 312 and the second wing 22. The passage 34 flares outwardly, having a maximum cross section area at the outer surfaces of the first wing 20 and the second wing 22. The first part 40 and the second part 42 of the stiffening member 326 are shaped to correspond with the shape of the passage 34, each of the first and second parts 40, 42 tapering inwardly. The first and second parts 40, 42 are thus effectively countersunk into the aerofoil 310, so that the outer surfaces of the first and second parts 40, 42 are flush with the outer surfaces of the first and second wings 20, 22. The first part 40 defines a threaded hole 36 in which a threaded projection 44 of the second part 42 is threadedly engageable therein to fasten the first part 40 and second part 42 together. A layer of adhesive (not shown) could be provided between the first and second parts 40, 42, and the first and second wings 20, 22 and the aerofoil body 312.

In a method for forming the aerofoil 310, the protection member 14 and the aerofoil body 12 could be assembled together and the passage 34 could then be formed therethrough. The first and second parts 40, 42 of the stiffening members 326 could then be located and threadedly engaged together.

In use, the stiffening member 326 increases the capacity of the protection member 14 to withstand a bending force applied, for example by an impact, increasing the second moment of area of the protection member 14. The stiffening member 326 hinders relative movement of the first and second wings 20, 22, and also provides interlock between the protection member 14 and the aerofoil body 12.

In the event of debonding of the protection member 14 from the aerofoil body 12, the passage 34 through the protection member 14 forms weakening holes which reduce the ability of the protection member 14 to withstand a compressive force applied along its length.

Various other modifications could be made without departing from the scope of the invention. The protection member could include any suitable number of stiffening members, which could be of any suitable form. There could be any suitable number of weakening holes, which could be of any suitable size and shape. Any feature of any of the embodiments shown could be used in any suitable combination.

There is thus provided an aerofoil having an increased resistance to impact, and increased resistance to debonding and a lower weight. Should debonding occur, the protection member which is released is more liable to buckle on impact, reducing impact damage to the engine.

The invention claimed is:

1. An aerofoil for a gas turbine engine, the aerofoil comprising:

a body and a protection member, the protection member extending along a length of the aerofoil body, the protection member including:

a protection member body;

a pair of spaced wings extending outwardly from the protection member body, the pair of spaced wings defining an aerofoil body receiving recess therebetween; and a stiffening member extending between the pair of spaced wings and extending along a length of the protection member, the stiffening member having a plurality of apertures therethrough, wherein a part of the aerofoil body protrudes through the plurality of apertures into the aerofoil body receiving recess.

2. The aerofoil according to claim 1, in which the stiffening member is in a form of a web.

3. The aerofoil according to claim 1, in which the aerofoil body includes an interlocking formation to provide interlock between the aerofoil body and the protection member.

4. The aerofoil according to claim 1, in which the aerofoil includes a filler, which is located in a cavity defined between the aerofoil body and the protection member.

5. The aerofoil according to claim 4, in which the filler acts to dampen vibrations.

6. The aerofoil according to claim 1, in which the protection member is formed of a metallic material, and the aerofoil body is formed of a composite material.

7. A gas turbine engine including the aerofoil according to claim 1.

8. The aerofoil according to claim 1, wherein the protection member defines a weakening feature which is arranged, in use, to reduce an ability of the protection member to withstand a compressive force applied along a length of the protection member.

9. A method of forming an aerofoil, the aerofoil comprising: an aerofoil body, the aerofoil body being formed of a composite material, and a protection member, the protection member being formed of a metallic material, the protection member including: a protection member body, and a pair of spaced wings extending outwardly from the protection member body, the pair of spaced wings defining an aerofoil body receiving recess therebetween; a stiffening member extending between the pair of spaced wings and extending along a length of the protection member, the stiffening member having a plurality of apertures therethrough; the method including the steps of locating the protection member in a mould, and then locating the composite material in the mould to form the aerofoil body against the protection member so that a part of the aerofoil body protrudes through the plurality of apertures into the aerofoil body receiving recess.

10. The aerofoil according to claim 8, wherein the weakening feature extends transversely across the length of the protection member.

11. The aerofoil according to claim 8, in which the protection member includes a plurality of weakening features.

* * * * *